US008297729B2

(12) United States Patent
Fujisawa

(10) Patent No.: US 8,297,729 B2
(45) Date of Patent: Oct. 30, 2012

(54) PRINTING DEVICE AND PRINTING METHOD

(75) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 12/841,391

(22) Filed: Jul. 22, 2010

(65) Prior Publication Data

US 2011/0018920 A1 Jan. 27, 2011

(30) Foreign Application Priority Data

Jul. 24, 2009 (JP) ..... 2009-173599

(51) Int. Cl.
*B41J 29/38* (2006.01)
*B41J 2/195* (2006.01)
*B41J 2/01* (2006.01)

(52) U.S. Cl. ..... 347/9; 347/6; 347/7; 347/102

(58) Field of Classification Search ..... 347/6–9, 347/102
See application file for complete search history.

(56) References Cited

U.S. PATENT DOCUMENTS 6,786,589 B2 9/2004 Suzuki et al.
7,661,808 B2 2/2010 Nakajima
2009/0295857 A1* 12/2009 Kikuchi et al. ..... 347/16

FOREIGN PATENT DOCUMENTS

JP 2004-001437 1/2004
JP 2007-210169 8/2007
WO 2006/025221 A1 3/2006

* cited by examiner

*Primary Examiner* — Jason Uhlenhake
(74) *Attorney, Agent, or Firm* — Workman Nydegger

(57) ABSTRACT

A printing device includes heads that eject electromagnetic wave hardened inks toward a medium and irradiation sections respectively corresponding to the heads. The irradiation sections irradiate the electromagnetic wave hardened inks. A controller controls the heads and the irradiation sections. The controller, when printing, sequentially performs a method that includes the following operations. One head ejects a first ink in a first ejecting operation. An irradiation section corresponding to the head irradiates first electromagnetic ink in a first irradiation operation. A different head ejects another ink toward a pixel on the medium such that the other ink overlaps the first ink, in a second ejecting operation. An irradiation section corresponding to the other head irradiates the other ink in a second irradiation operation. The controller performs the operations such that a contact angle of the other ink relative to the first ink is greater than 90 degrees.

5 Claims, 5 Drawing Sheets

PRINTING DEVICE AND PRINTING METHOD

The entire disclosure of Japanese Patent Application No. 2009-173599, filed Jul. 24, 2009 is expressly incorporated by reference herein.

BACKGROUND

1. Technical Field

The present invention relates to a printing device and a printing method.

2. Related Art

There is already known a printing device having a plurality of heads which eject different inks toward a medium. As the printing device, there is known an ink jet printer which ejects inks on various kinds of media such as paper, fabric, film or the like and performs a printing. Also, among such printing devices, there is a printing device which uses an electromagnetic wave hardened ink which is hardened by irradiation of electromagnetic waves such as ultraviolet rays or the like. The printing device includes a plurality of irradiation sections which irradiate the electromagnetic waves to the respective different electromagnetic wave hardened inks ejected by the plurality of heads.

JP-A-2004-1437 is an example of the related art.

The printing device sequentially performs, at the time of the printing, a first ejecting operation where one head of the plurality of heads ejects one electromagnetic wave hardened ink of the different electromagnetic wave hardened inks, a first irradiation operation where an irradiation section corresponding to the one head irradiates the electromagnetic wave to the one electromagnetic wave hardened ink, a second ejecting operation where another head ejects another electromagnetic wave hardened ink toward a pixel on a medium where the one electromagnetic wave hardened ink is ejected such that the another electromagnetic wave hardened ink overlaps the one electromagnetic wave hardened ink, and a second irradiation operation where an irradiation section corresponding to the another head irradiates the electromagnetic wave to the another electromagnetic wave hardened ink. At this time, the another electromagnetic wave hardened ink overlaps the one electromagnetic wave hardened ink; however, there is a case where an image quality of the images is deteriorated due to aspects of the methods for overlapping the electromagnetic wave hardened inks.

SUMMARY

An advantage of some aspects of the invention is to suppress deterioration of an image quality of the images.

According to an aspect of the invention, a printing device includes a plurality of heads configured to eject different electromagnetic wave hardened inks toward a medium; a plurality of irradiation sections configured to respectively correspond to the plurality of heads and to respectively irradiate electromagnetic waves to the different electromagnetic wave hardened inks ejected from the plurality of heads; and a controller configured to control the heads and the irradiation sections. Here, the controller, when performing a printing, sequentially performs, a first ejecting operation where one head of the plurality of heads ejects one electromagnetic wave hardened ink of the different electromagnetic wave hardened inks; a first irradiation operation where an irradiation section, among the plurality of irradiation sections, corresponding to the one head irradiates the electromagnetic wave to the one electromagnetic wave hardened ink; a second ejecting operation where another head different from the one head ejects another electromagnetic wave hardened ink different from the one electromagnetic wave hardened ink toward a pixel on the medium where the one electromagnetic wave hardened ink is ejected such that the another electromagnetic wave hardened ink overlaps the one electromagnetic wave hardened ink; and a second irradiation operation where an irradiation section corresponding to the another head irradiates the electromagnetic wave to the another electromagnetic wave hardened ink, and wherein the controller performs the operations such that a contact angle of the other electromagnetic wave hardened ink relative to the one electromagnetic wave hardened ink is greater than 90 degrees.

Other features of the invention will be shown throughout the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
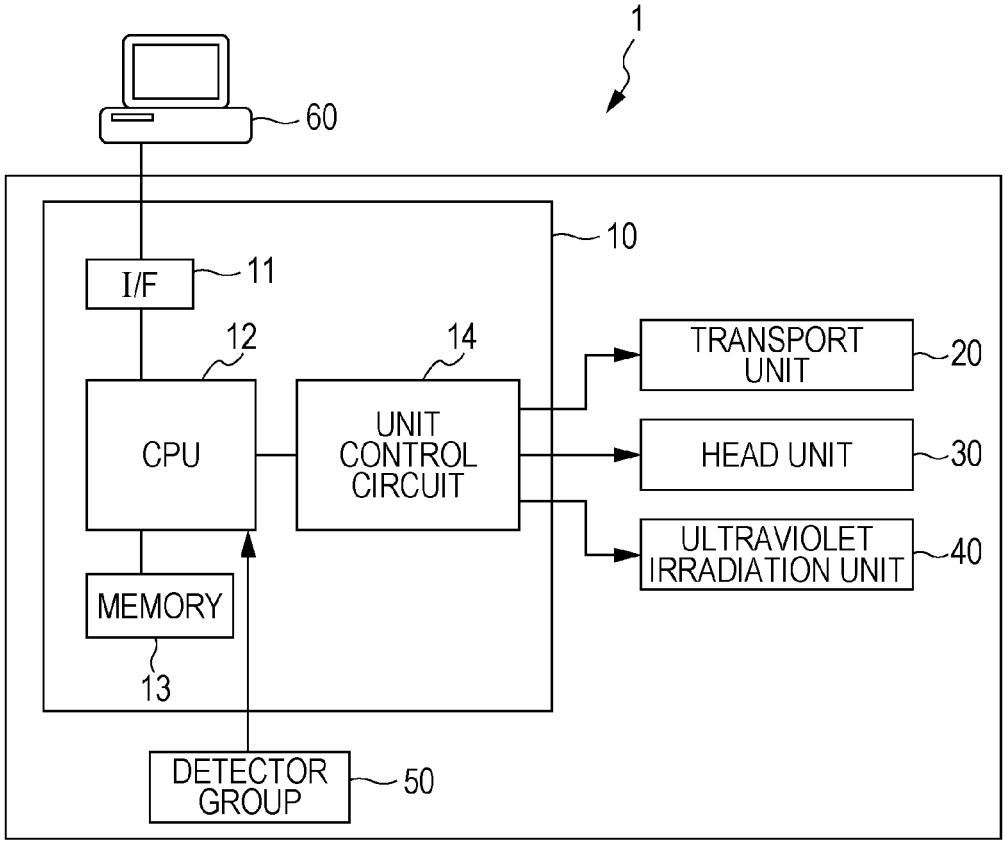
FIG. 1 is a block diagram of a printer according to this embodiment of the invention.

The following becomes apparent by the description of this specification and the accompanying drawings.

According to an embodiment of the invention, a printing device includes a plurality of heads configured to eject different electromagnetic wave hardened inks toward a medium; a plurality of irradiation sections configured to respectively correspond to the plurality of heads and to respectively irradiate electromagnetic waves to the different electromagnetic wave hardened inks ejected from the plurality of heads; and a controller configured to control the heads and the irradiation sections.

Here, the controller, when performing a printing, sequentially performs, a first ejecting operation where one head of the plurality of heads ejects one electromagnetic wave hardened ink of the different electromagnetic wave hardened inks; a first irradiation operation where an irradiation section, among the plurality of irradiation sections, corresponding to the one head irradiates the electromagnetic wave to the one electromagnetic wave hardened ink; a second ejecting operation where another head different from the one head ejects another electromagnetic wave hardened ink different from the one electromagnetic wave hardened ink toward a pixel on the medium where the one electromagnetic wave hardened ink is ejected such that the another electromagnetic wave hardened ink overlaps the one electromagnetic wave hardened ink; and a second irradiation operation where an irradiation section corresponding to the another head irradiates the electromagnetic wave to the another electromagnetic wave hardened ink.

In this case, the controller performs the operations such that a contact angle of the another electromagnetic wave hardened ink relative to the one electromagnetic wave hardened ink is greater than 90 degrees.

According to the printing device, it is possible to suppress the deterioration of an image quality of the images.

Also, the plurality of irradiation sections may be preliminary irradiation sections which temporarily harden the electromagnetic wave hardened inks by irradiating the electromagnetic wave to the electromagnetic wave hardened inks.

In this case, the printing device may further include a main irradiation section which really hardens the electromagnetic wave hardened inks by irradiating the electromagnetic wave to the electromagnetic wave hardened inks, independently from the plurality of irradiation sections.

Here, the controller, when performing a printing, may perform the first ejecting operation, the first irradiation operation, the second ejecting operation, and the second irradiation operation, and thereafter control the main irradiation section to perform a main hardening treatment where the electromagnetic wave hardened inks are really hardened.

In addition, the printing device may further include a movement instrument which moves the medium.

Here, the controller, when performing a printing, may perform the first ejecting operation, the first irradiation operation, the second ejecting operation, and the second irradiation operation, subsequently control the movement instrument to a movement processing where the medium is moved, and thereafter perform the main hardening treatment.

In this case, the validity of the invention is higher as compared with when, for example, the medium is not moved.

Also, the plurality of heads may be colored ink heads which eject different electromagnetic wave hardened colored ink toward the medium, wherein the printing head may further include, a clear ink head which ejects an electromagnetic wave hardened clear ink toward the medium, independently from the plurality of heads, and another irradiation section which irradiates the electromagnetic wave to the electromagnetic wave hardened clear ink, independently from the plurality of the irradiation sections.

Here, the controller, when performing a printing, may sequentially perform a third ejecting operation where one head of the plurality of heads ejects one electromagnetic wave hardened ink of the different electromagnetic wave hardened inks, a third irradiation operation where an irradiation section, among the plurality of irradiation sections, corresponding to the one head irradiates the electromagnetic wave to the one electromagnetic wave hardened ink, a fourth ejecting operation where the clear ink head ejects the electromagnetic wave hardened clear ink toward a pixel on the medium where the one electromagnetic wave hardened ink is ejected such that the electromagnetic wave hardened clear ink overlaps the one electromagnetic wave hardened ink, and a fourth irradiation operation where the another irradiation section irradiates the electromagnetic wave to the electromagnetic wave hardened clear ink, and wherein the controller may perform the operations such that a contact angle of the electromagnetic wave hardened clear ink relative to the one electromagnetic wave hardened ink is smaller than 90 degrees.

In this case, an object that the clear ink lays on a gloss is appropriately achieved.

According to another aspect of the invention, a printing method includes preparing a printing device having a plurality of heads configured to eject different electromagnetic wave hardened inks toward a medium, a plurality of irradiation sections configured to respectively correspond to the plurality of heads and to respectively irradiate electromagnetic wave to the different electromagnetic wave hardened inks ejected from the plurality of heads, and a controller configured to control the heads and the irradiation sections; performing a first ejecting operation where one head of the plurality of heads ejects one electromagnetic wave hardened ink of the different electromagnetic wave hardened inks; performing a first irradiation operation where an irradiation section, among the plurality of irradiation sections, corresponding to the one head irradiates the electromagnetic wave to the one electromagnetic wave hardened ink; performing a second ejecting operation where another head different from the one head ejects another electromagnetic wave hardened ink different from the one electromagnetic wave hardened ink toward a pixel on the medium where the one electromagnetic wave hardened ink is ejected such that the another electromagnetic wave hardened ink overlaps the one electromagnetic wave hardened ink; and performing a second irradiation operation where an irradiation section corresponding to the another head irradiates the electromagnetic wave to the another electromagnetic wave hardened ink.

Here, the operations are performed such that a contact angle of the another electromagnetic wave hardened ink relative to the one electromagnetic wave hardened ink is greater than 90 degrees.

According to the printing method, it is possible to suppress the deterioration of an image quality of the images.

Summary of Printer 1

Configuration of the Printer 1

As a printing device, an ink jet printer (hereinafter, referred to as a "printer 1") is exemplified, and embodiments will be described by the use of a printing system where the printer 1 and a computer 60 are connected to each other.

Figure 2:
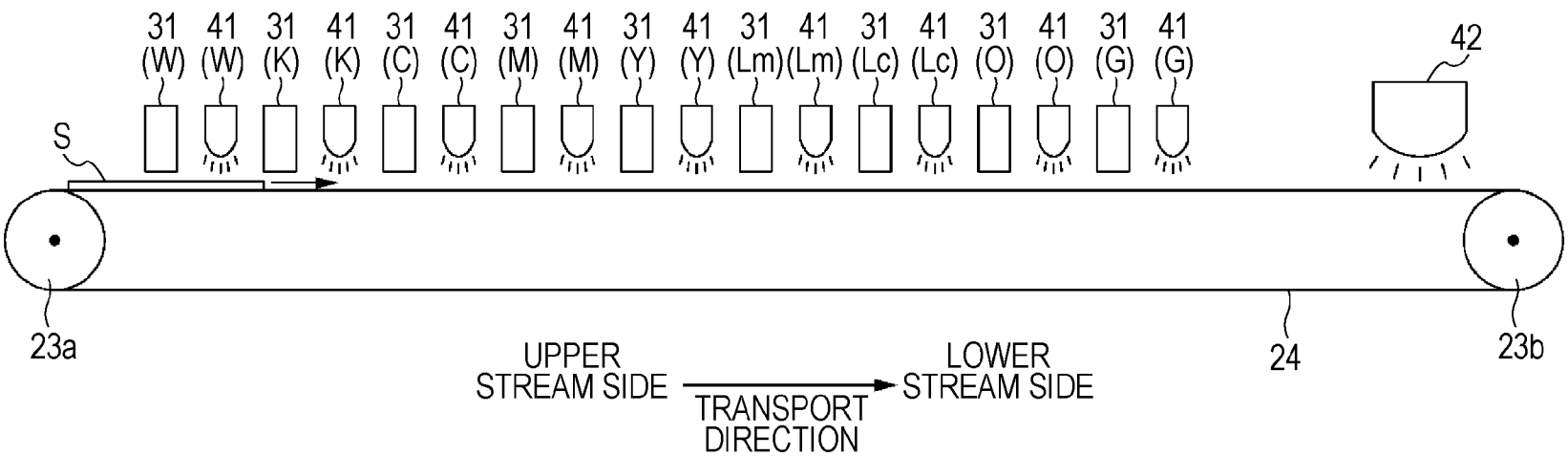
FIG. 2 is a schematic sectional view of the printer.

FIG. 1 is a block diagram illustrating an entire configuration of the printer 1 according to this embodiment. FIG. 2 is a schematic sectional view of the printer 1. The printer 1, which receives a printing instruction (printing data) from the computer 60 which is an external device, controls the respective units (a transport unit 20, a head unit 30, an ultraviolet irradiation unit 40) under the control of a controller 10, and forms images on a paper S. A detector group 50 checks a situation in the printer 1, and the controller 10 controls the respective units based on the checked result.

The controller 10 is a control unit which controls the printer 1. An interface section 11 performs transmission and reception of data between the computer 60 which is an external device and the printer 1. A CPU 12 is an operational processing device which controls the printer 1 entirety. A memory 13 is an area for storing programs of the CPU 12 or is for securing a working area or the like. The CPU 12 controls the respective units by a unit control circuit 14 according to the programs stored in the memory 13.

The transport unit 20 (equivalent to a movement instrument) transports the paper S, which is an example of a medium, in a predetermined direction (hereinafter, referred to as a "transport direction"). The transport unit 20 includes, as shown in FIG. 2, an upper stream side transport roller 23*a*, a lower stream side transport roller 23*b*, and a belt 24. When a transport motor (not shown) rotates, the upper stream side transport roller 23*a* and the lower stream side transport roller 23*b* rotate, and thereby the belt 24 rotates. The paper S fed by a paper feed roller (not shown) is transported to a printable area (an area facing the heads) by the belt 24. The belt 24 transports the paper S, and this moves the paper S in the transport direction with respect to the head unit 30. The paper S passing through the printable area is discharged to the outside by the belt 24. The paper S in the course of the transport is electrostatically-adsorbed or vacuum-adsorbed to the belt 24.

The head unit 30 includes heads 31 for ejecting inks on the paper. The printer 1 shown in FIG. 2 is provided with a plurality of heads 31 which eject different inks toward the paper S. Each of the heads 31 is provided, in its lower part, with a plurality of nozzles which are ink ejecting sections. Each nozzle includes a pressure room (not shown) containing the ink, and a driving element (for example, a piezoelectric element) which enables the ink to be ejected by varying a capacity of the pressure room. A driving signal is supplied to the driving element to modify the driving element, and the modification expands and contracts the pressure room so as to eject the ink.

In this embodiment, an ultraviolet hardened ink, which is hardened by irradiating ultraviolet rays as an example of the electromagnetic waves, is used as an example of electromagnetic wave hardened ink. Here, the ultraviolet hardened ink (hereinafter, simply referred to as "ink") is prepared by adding supplements such as antifoaming agent, polymerization inhibitor or the like into a mixture of vehicle, photopolymerization initiator, and pigment mixture. The vehicle is prepared by the viscosity control of oligomer or monomer having the photopolymerization hardening characteristic by the use of reactive diluents. The ink may include both water-based ink and oil-based ink.

The printer 1 can eject colored inks of nine colors. There are provided one by one from the upper stream side to the lower stream side in the transport direction, a head 31(W) ejecting a white ink W, a head 31(K) ejecting a black ink (K), a head 31(C) ejecting a cyan ink C, a head 31(M) ejecting a magenta ink M, a head 31(Y) ejecting a yellow ink Y, a head 31(Lm) ejecting a light magenta ink Lm, a head 31(Lc) ejecting a light cyan ink Lc, a head 31(O) ejecting an orange ink O, and a head 31(G) ejecting a green ink G.

The ultraviolet irradiation unit 40 hardens inks by irradiating ultraviolet rays to the inks ejected on the paper S by the heads 31. The ultraviolet irradiation unit 40 has a preliminary irradiation section 41 (equivalent to a plurality of irradiation sections) which temporarily hardens the inks by irradiating ultraviolet rays to the inks, and a main irradiation section 42 which really hardens the inks by irradiating the ultraviolet rays to the inks. The preliminary irradiation section 41 and the main irradiation section 42 have lamps (for example, a metal halide lamp or an LED or the like) which irradiate ultraviolet rays to the ultraviolet hardened inks to be hardened.

In addition, the preliminary irradiation section 41 irradiates ultraviolet rays with irradiation intensity lower than the main irradiation section 42. By this, the ultraviolet hardened inks ejected out of the heads 31 are not completely hardened (temporary hardening) by the ultraviolet rays irradiated from the preliminary irradiation section 41, but are completely hardened by the ultraviolet rays irradiated from the main irradiation section 42 (main hardening).

The printer 1 in this embodiment is provided with a plurality of preliminary irradiation sections 41, corresponding to the respective plural heads 31, which irradiate ultraviolet rays to the respective different inks ejected by the plurality of heads 31. More precisely, there are provided one by one, from the upper stream side to the lower stream side in the transport direction, a preliminary irradiation section 41(W) corresponding to the head 31(W) which ejects the white ink W, placed in the lower stream side when seen from the head 31(W) and irradiating ultraviolet rays to the white ink W, a preliminary irradiation section 41(K) corresponding to the head 31(K) which ejects the black ink K, placed in the lower stream side when seen from the head 31(K) and irradiating ultraviolet rays to the black ink K, a preliminary irradiation section 41(C) corresponding to the head 31(C) which ejects the cyan ink C, placed in the lower stream side when seen from the head 31(C) and irradiating ultraviolet rays to the cyan ink C. In addition, there are provided a preliminary irradiation section 41(M) corresponding to the head 31(M) which ejects the magenta ink M, placed in the lower stream side when seen from the head 31(M) and irradiating ultraviolet rays to the magenta ink M. In addition, there are provided a preliminary irradiation section 41(Y) corresponding to the head 31(Y) which ejects the yellow ink Y, placed in the lower stream side when seen from the head 31(Y) and irradiating ultraviolet rays to the yellow ink Y, a preliminary irradiation section 41(Lm) corresponding to the head 31(Lm) which ejects the light magenta ink Lm, placed in the lower stream side when seen from the head 31(Lm) and irradiating ultraviolet rays to the light magenta ink Lm, a preliminary irradiation section 41(Lc) corresponding to the head 31(Lc) which ejects the light cyan ink Lc, placed in the lower stream side when seen from the head 31(Lc) and irradiating ultraviolet rays to the light cyan ink Lc, a preliminary irradiation section 41(O) corresponding to the head 31(O) which ejects the orange ink O, placed in the lower stream side relative to the head 31(O) and irradiating ultraviolet rays to the orange ink O, and a preliminary irradiation section 41(G) corresponding to the head 31(G) which ejects the green ink G, placed in the lower stream side when seen from the head 31(G) and irradiating ultraviolet rays to the green ink G. Also, there is provided only one main irradiation section 42 in the lowest stream side in the transport direction.

Operation of the Printer 1

The printer 1 according to this embodiment has a number of printing modes. For example, the printing modes include a printing mode where color images are printed by the use of the cyan, magenta, and yellow inks (hereinafter, referred to as a "first printing mode"), a printing mode where color images are printed on a background image of white (ink) by the use of the cyan, magenta, and yellow inks (hereinafter, referred to as a "second printing mode"), and a printing mode where color images are printed by the use of all the inks other than the white ink (referred to as a "third printing mode"), etc. All of the above-described nine heads 31 and the nine preliminary irradiation sections 41 are not always used, but which head 31 and preliminary irradiation section 41 are used is different depending on the printing modes. In other words, when the printing is performed in the first printing mode, the three heads 31 and the three preliminary irradiation sections 41 corresponding to the cyan, magenta and yellow inks work. When the printing is performed in the second printing mode, the four heads 31 and the four preliminary irradiation sections 41 corresponding to the white, cyan, magenta, and yellow inks work. When the printing is performed in the third printing mode, the eight heads 31 and the eight preliminary irradiation sections 41 corresponding to the colored inks other than the white ink work.

Hereinafter, a printing operation of the printer 1 will be described by exemplifying the case where printing is performed in the first printing mode. Various kinds of operation in the printer 1 at the time of the printing are mainly implemented by the controller 10. Particularly, in this embodiment, the CPU 12 processes the programs stored in the memory 13 to implement the operations. The programs are constituted by codes for performing various kinds of operation described below.

When receiving printing data, the controller 10 feeds the paper S on the belt 24. The paper S is transported by the belt 24 without stopping at a constant speed, and finally faces the head 31(C). At this time, the controller 10 controls the head 31(C) to perform a cyan ink ejecting operation where the head 31(C) ejects the cyan ink. Next, the controller 10 controls the preliminary irradiation section 41(C) to perform a cyan ink irradiation operation (temporary hardening treatment for temporarily hardening the cyan ink) where the preliminary irradiation section 41(C) irradiates ultraviolet rays to the cyan ink ejected on the paper S (during this time, the transport operation of the paper S is continued). Thereafter, the controller 10 sequentially controls the head 31(M), the preliminary irradiation section 41(M), the head 31(Y), and the preliminary irradiation section 41(Y), to perform a magenta ink ejecting operation, a magenta ink irradiation operation (magenta ink temporary hardening treatment), a yellow ink ejecting operation, and a yellow ink irradiation operation (yellow ink temporary hardening treatment) (the ink ejecting and the preliminary irradiation are completed here). After the completion of the preliminary irradiation, the controller 10 controls the main irradiation section 42 to perform a main hardening treatment where the inks are really hardened. By such operations, the printing of images on the paper S is completed, and the paper S is discharged to the outside.

Shapes of Inks on the Paper S

Figure 3A:
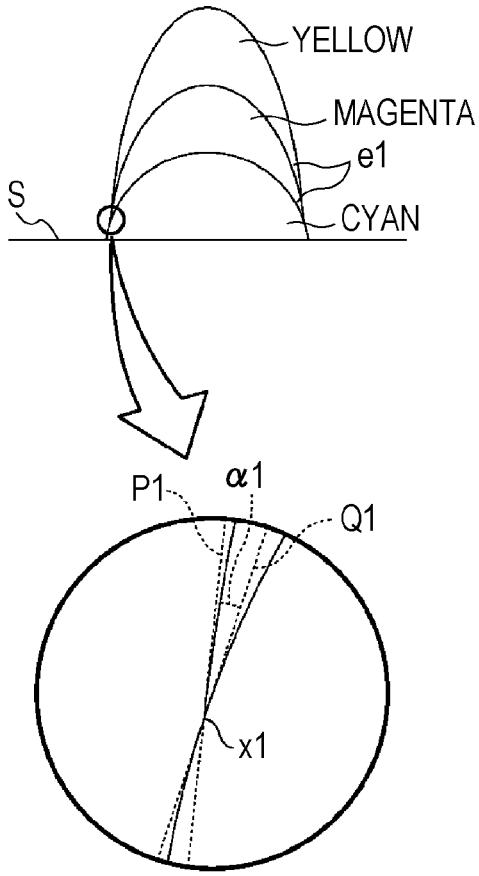
FIG. 3A is a schematic diagram illustrating shapes of ultraviolet hardened inks on a paper according to a comparative example.
Figure 3B:
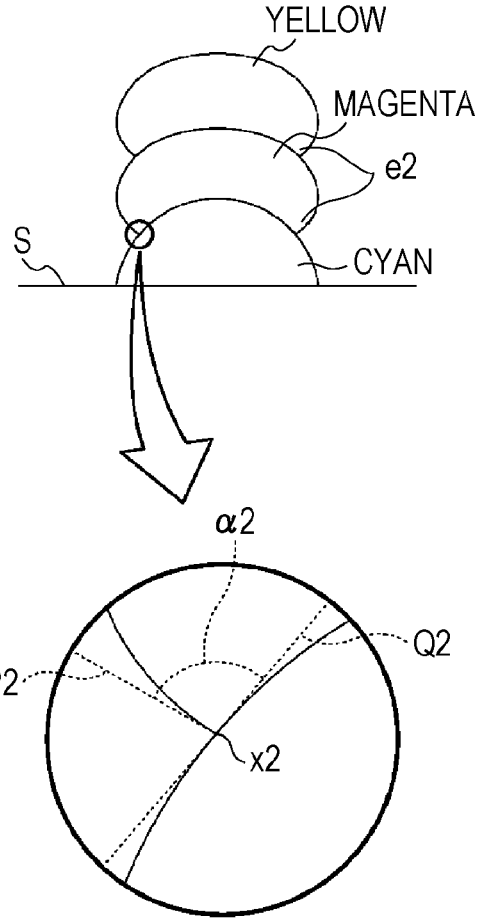
FIG. 3B is a schematic diagram illustrating shapes of ultraviolet hardened inks on a paper according to this embodiment.

Here, shapes of ultraviolet hardened inks which are overlapped on the paper S due to the above-described printing operation (the printing in the first printing mode) are observed by comparing this embodiment example with a related art example (comparative example) with reference to the drawings. FIG. 3A is a schematic diagram illustrating shapes of the ultraviolet hardened inks on the paper S according to the related art, and FIG. 3B is a schematic diagram illustrating shapes of the ultraviolet hardened inks on the paper S according to this embodiment example. The lower illustrations in FIGS. 3A and 3B expand the circled portions of the upper illustrations and indicate contact angles.

When the above-described printing operation (printing in the first printing mode) is performed, the cyan, magenta and yellow inks can be overlap sequentially (color is represented by this overlap) as shown in FIGS. 3A and 3B. Here, unlike the typical water-based ink, in the ultraviolet hardened inks, the state where the respective cyan, magenta, and yellow inks are overlapped is clearly shown since the solvent is not evaporated.

As such, both the comparative example and this embodiment example are common in that the state where the respective inks are overlapped is clearly shown, but they are different in aspects where the overlying inks relative to the underlying inks (that is, the magenta ink relative to the cyan ink, or the yellow ink relative to the magenta ink) are overlapped. That is to say, as clearly shown in FIGS. 3A and 3B, in the comparative example, end portions (indicated by the reference numeral e1) of the overlying inks are broadened outwardly, and, in this state, the overlying inks overlap the underlying inks, whereas, in this embodiment example, end portions (indicated by the reference numeral e2) of the overlying inks are forced to be put inwardly, and, in this state, the overlying inks overlap the underlying inks.

This difference causes demerits in the comparative example but causes merits in this embodiment example. In other words, in the comparative example, since the end portions e1 of the overlying inks extend outwardly, the corresponding portions are easily omitted. When a certain vibration is given to the paper S (for example, a vibration when the paper S is being transported), there is a high possibility that the omission occurs, and when the omission has occurred, the image quality of the images is deteriorated. In contrast, since, in this embodiment example, the end portions e2 of the overlying inks are forced to be put inwardly, the corresponding portions are difficult to be omitted. For this reason, even when a vibration or the like is given to the paper S, the omission hardly occurs, and thus the deterioration of the image quality of the images can be appropriately suppressed.

This embodiment example where the end portions e2 of the overlying inks are forced to be put inwardly has better characteristics than the comparative example where the end portions e1 of the overlying inks extend outwardly; however, whether the end portions extend outwardly or are forced to be put inwardly can be divided by a contact angle of the overlying ink relative to the underlying ink. That is to say, in the comparative example, the corresponding contact angle $\alpha 1$ is smaller than 90 degrees (lower illustration in FIG. 3A), whereas, in this embodiment example, the contact angle $\alpha 2$ is greater than 90 degrees (lower illustration in FIG. 3B). Also, it can be understood from FIGS. 3A and 3B that a boundary line of whether the end portions extend outwardly or are forced to be put inwardly is the contact angle=90 degrees. Also, when a tangent line P1 (P2) for the overlying ink and a tangent line Q1 (Q2) for the underlying ink are disposed at the farthest point x1 (x2) of the overlying ink, the contact angle $\alpha 1$ ($\alpha 2$) of the overlying ink relative to the underlying ink is an angle formed by the tangent lines P1 and Q1 (P2 and Q2). The contact angle is an angle which is clearly shown, when the ejecting operation of the underlying ink, the irradiation operation to the underlying ink (temporary hardening treatment), the ejecting operation of the overlying ink, and the irradiation operation to the overlying ink (temporary hardening treatment) are all performed and the shapes of the overlying ink and the underlying ink are fixed (also, after the four processings are all performed and the contact angle is clearly shown, the contact angle hardly varies in subsequent processings).

That is to say, in this embodiment example, the contact angle $\alpha 2$ is greater than 90 degrees, and thus the end portions e2 are forced to be put inwardly, thereby causing the above-described merits. It is possible to control to which value the contact angle is set (making the contact angle greater than 90 degrees) (a detailed control method thereof will be described later).

In this embodiment example, when the printing is performed, the controller 10 sequentially performs, such that the contact angle of the magenta ink (the overlying ink) relative to the cyan ink (the underlying ink) is greater than 90 degrees, a cyan ink ejecting operation (equivalent to the first ejecting operation) where the head 31(C) (equivalent to the one head) ejects the cyan ink (equivalent to the one electromagnetic wave hardened ink), a cyan ink irradiation operation (equivalent to the first irradiation operation) where the preliminary irradiation section 41(C) (equivalent to the irradiation section corresponding to the one head) irradiates ultraviolet rays to the cyan ink, a magenta ink ejecting operation (equivalent to the second ejecting operation) where the head 31(M) (equivalent to the another head) ejects the magenta ink (equivalent to the another electromagnetic wave hardened ink) toward a pixel on the paper S where the cyan ink is ejected so that the magenta ink overlaps the cyan ink, and a magenta ink irradiation operation (equivalent to the second irradiation operation) where the preliminary irradiation section 41(M) (equivalent to the irradiation section corresponding to the another head) irradiates ultraviolet rays to the magenta ink. In addition, in this embodiment example, when the printing is performed, the controller 10 sequentially performs, such that the contact angle of the yellow ink (the overlying ink) relative to the magenta ink (the underlying ink) is greater than 90 degrees, a magenta ink ejecting operation (equivalent to the first ejecting operation) where the head 31(M) (equivalent to the one head) ejects the magenta ink (equivalent to the one electromagnetic wave hardened ink), a magenta ink irradiation operation (equivalent to the first irradiation operation) where the preliminary irradiation section 41(M) (equivalent to the irradiation section corresponding to the one head) irradiates ultraviolet rays to the magenta ink, a yellow ink ejecting operation (equivalent to the second ejecting operation) where the head 31(Y) (equivalent to the another head) ejects the yellow ink (equivalent to the another electromagnetic wave hardened ink) toward a pixel on the paper S where the magenta ink is ejected so that the yellow ink overlaps the magenta ink, and a yellow ink irradiation operation (equivalent to the second irradiation operation) where the preliminary irradiation section 41(Y) (equivalent to the irradiation section corresponding to the another head) irradiates ultraviolet rays to the yellow ink. As described above, this appropriately suppresses the deterioration of the image quality of the images.

Method for Controlling the Contact Angle

Here, a method for controlling the contact angle will be described. A magnitude of the contact angle depends on the temporary hardening extent of the overlying ink and the underlying ink (that is, what percentage of monomer in the ultraviolet hardened ink is changed to polymer) when the overlying ink and the underlying ink are temporarily hardened. Thereby, when irradiation intensity of the preliminary irradiation sections 41 is controlled, the contact angle can be set to a desired value (that is, greater than 90 degrees). Especially, the temporary hardening extent of the underlying ink has greatly influences the contact angle (there is a tendency for the contact angle to be increased as the temporary hardening extent of the underlying ink is heightened), and thus it is best to principally control the irradiation intensity of the preliminary irradiation section 41 which irradiates ultraviolet rays to the underlying ink.

The control is performed, for example, as follows before shipment of the printer 1 or the like. That is to say, the above-described four operations (the underlying ink ejecting operation, the irradiation operation to the underlying ink (temporary hardening treatment), the overlying ink ejecting operation, the irradiation operation to the overlying ink (temporary hardening treatment)) are performed, and thereafter the contact angle of the overlying ink relative to the underlying ink is actually measured on the paper S. When the measured value for the contact angle is not a desired value, the irradiation intensity of the preliminary irradiation section 41 is changed, which is repeatedly performed until the measured value becomes the desired value. When the measured value becomes the desired value, irradiation intensity at this time is set to the preliminary irradiation section 41.

The contact angle is measured by related art methods without difficulty, but when the contact angle is difficult to measure, a so-called solid image may be formed at the underlying ink ejecting operation. If the solid image is formed, since a surface formed by the underlying ink is an even plane the same as a surface of the paper S, the contact angle of the overlying ink relative to the underlying ink can be simply measured just as a contact angle of the overlying ink on the paper S is measured. The contact angle of the overlying ink relative to the underlying ink at the time of forming the solid image are the same as the contact angle of the overlying ink relative to the underlying ink at the time of not forming the solid image, if the irradiation intensities are the same.

Other Embodiments

Although, in the above-described embodiment, the printing device has been mainly described, a printing method or the like has also been described. The embodiment is for better understanding of the invention and is not to be construed as limiting the invention. The invention may be modified and changed without departing from the scope thereof and moreover apparently includes the equivalents thereof. Particularly, embodiments described below are included in the invention.

Also, in the above-described embodiment, the printing device has been embodied as the ink jet printer, but the invention is not limited thereto and is applicable to any other printing device.

In the above-described embodiment, the ultraviolet hardened ink has been exemplified as the electromagnetic wave hardened ink, but the invention is not limited thereto. For example, there may be ink which is hardened by electromagnetic waves such as electron rays, X-rays, visible rays, infrared rays, or the like.

In the above-described embodiment, it has been described that the plurality of irradiation sections are the preliminary irradiation sections 41 which irradiate ultraviolet rays to the ultraviolet hardened inks to temporarily harden the ultraviolet hardened inks, and the main irradiation section 42 is provided independently from the plurality of preliminary irradiation sections and irradiates ultraviolet rays to the ultraviolet hardened inks to really harden the ultraviolet hardened inks. In addition, it has been described that the controller 10, at the time of the printing, performs the first ejecting operation and the first irradiation operation, the second ejecting operation, and the second irradiation operation, and thereafter controls the main irradiation section 42 to perform the main hardening treatment where the ultraviolet hardened inks are really hardened. However, the invention is not limited thereto.

For example, the plurality of irradiation sections may be the main irradiation section 42, and the first irradiation operation and the second irradiation operation may be performed by the main irradiation section 42.

It has been described that the printer 1 according to the embodiment has the transport unit 20 which moves the paper S, and the controller 10, at the time of the printing, performs the first ejecting operation and the first irradiation operation, the second ejecting operation, and the second irradiation operation, subsequently controls the transport unit 20 to perform the movement processing where the paper S is moved, and thereafter performs the main hardening treatment. However, the invention is not limited thereto.

For example, the invention is also applicable to the printer 1 in which the paper S is not moved, but the heads 31, the preliminary irradiation sections 41, and the main irradiation section 42 are moved to perform the printing.

Only, in the printer 1 where the controller 10, at the time of the printing, performs the first ejecting operation and the first irradiation operation, the second ejecting operation, and the second irradiation operation, subsequently controls the transport unit 20 to perform the movement processing where the paper S is moved, and thereafter performs the main hardening treatment, at the time of the corresponding movement processing, the possibility that the above-described end portion of the overlying ink is omitted downwardly is higher as compared with when the paper S is not moved. For this reason, when the invention is applied to the printer 1 where the controller 10, at the time of the printing, performs the first ejecting operation and the first irradiation operation, the second ejecting operation, and the second irradiation operation, subsequently controls the transport unit 20 to perform the movement processing where the paper S is moved, and thereafter performs the main hardening treatment, this is more preferable in that the validity of the invention for suppressing the omission is heightened.

In the above-described embodiment (hereinafter, referred to as the "first embodiment"), although the printer 1 where only the colored inks are ejected has been described as an example, the invention is not limited thereto, and another embodiment (hereinafter, referred to a "second embodiment") is considered.

Figure 4:
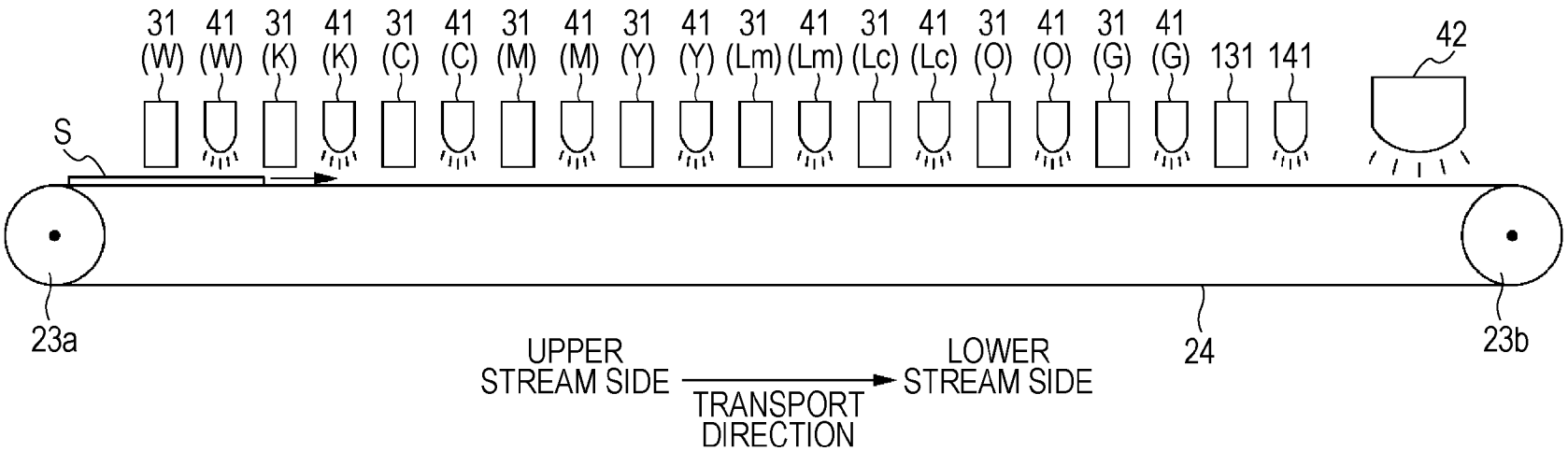
FIG. 4 is a schematic sectional view of a printer according to a second embodiment of the invention.

FIG. 4 corresponds to FIG. 2 and is a schematic sectional view of a printer 1 according to the second embodiment. The printer 1 according to the second embodiment has a clear ink head 131 which ejects a colorless ultraviolet hardened clear ink toward the paper S (the clear ink head 131 is provided in the lower stream than the plurality of heads 31 in the transport direction), independently from the plurality of heads 31 (that is, the colored ink heads which eject the ultraviolet hardened colored ink toward the paper S). In addition, the printer 1 has a clear ink preliminary irradiation section 141 which is an example of another irradiation section which irradiates ultraviolet rays to ultraviolet hardened clear ink, independently from the plurality of irradiation sections (that is, the nine preliminary irradiation sections 41) (the clear ink preliminary irradiation section 141 is provided in the lower stream than the nine preliminary irradiation sections 41 and in the upper stream than the main irradiation section 42 in the transport direction).

The printer 1 according to the second embodiment also has a number of printing modes like the printer 1 according to the first embodiment. For example, the printer 1 has the above-described first printing mode to the third printing mode, and also has a printing mode where color images are printed by the use of the cyan, magenta, and yellow inks, and finally wears a gloss thereon by ejecting the clear ink (hereinafter, referred to as a "fourth printing mode") or the like.

Figure 5:
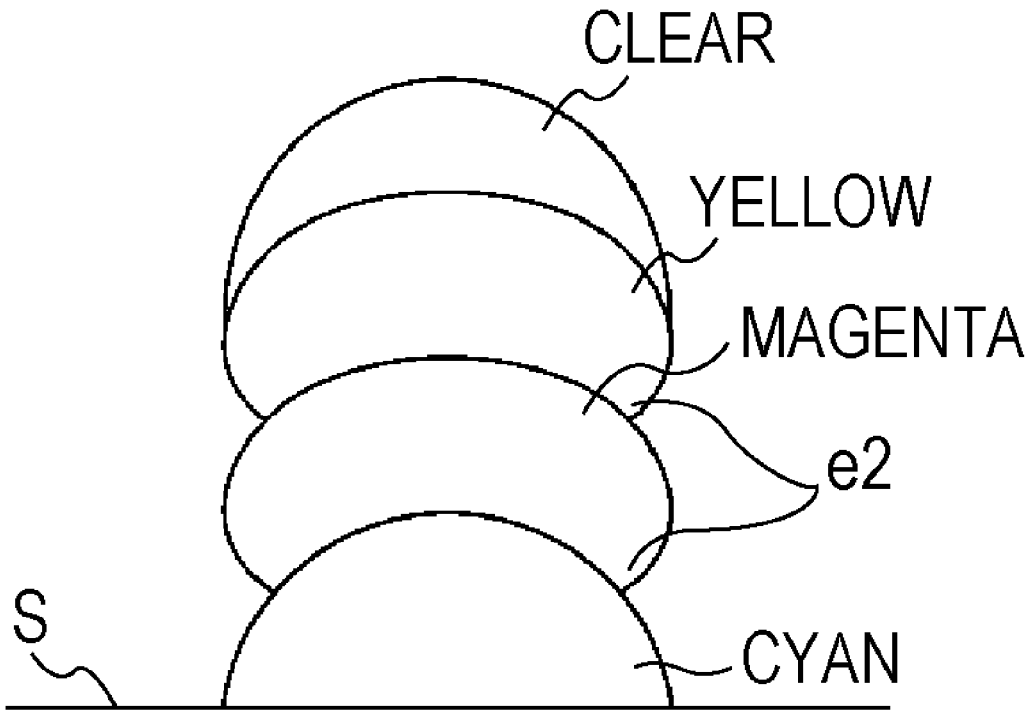
FIG. 5 is a schematic diagram illustrating shapes of ultraviolet hardened inks on a paper according to the second embodiment of the invention.

FIG. 5 corresponds to FIG. 3B and is a schematic diagram illustrating shapes of the ultraviolet hardened inks on the paper according to the second embodiment. When the printing is performed in the fourth printing mode, the cyan, magenta, yellow, and clear inks are sequentially overlapped. As shown in FIG. 5, in the second embodiment, the contact angle of the magenta ink relative to the cyan ink or the contact angle of the yellow ink relative to the magenta ink is greater than 90 degrees like the first embodiment. In contrast, the contact angle of the clear ink relative to the yellow ink is smaller than 90 degrees.

In other words, the controller 10 sequentially performs, such that the contact angle of the clear ink (the overlying ink) relative to the yellow ink (the underlying ink) is smaller than 90 degrees, a yellow ink ejecting operation (equivalent to the third ejecting operation) where the head 31(Y) (equivalent to the one head) ejects the yellow ink (equivalent to the one electromagnetic wave hardened ink), a yellow ink irradiation operation (equivalent to the third irradiation operation) where the preliminary irradiation section 41(Y) (equivalent to the irradiation section corresponding to the one head) irradiates ultraviolet rays to the yellow ink, a clear ink ejecting operation (equivalent to the fourth ejecting operation) where the clear ink head 131 ejects the clear ink toward a pixel on the paper where the yellow ink is ejected so that the clear ink overlaps the yellow ink, and a clear ink irradiation operation (equivalent to the fourth irradiation operation) where the clear ink preliminary irradiation section 141 irradiates ultraviolet rays to the clear ink.

The reason for doing so is as follows. That is to say, since the clear ink is a clear and colorless ink, even though the above-described omission occurs, the image quality of the images is not deteriorated, but rather, it is better that the clear ink is widespread on the entire image plane (in this case, an objective that the clear ink lays on a gloss is appropriately achieved).

What is claimed is:

1. A printing device comprising:

a plurality of heads configured to eject different electromagnetic wave hardened inks toward a medium;

a plurality of irradiation sections configured to respectively correspond to the plurality of heads and to respectively irradiate electromagnetic waves to the different electromagnetic wave hardened inks ejected from the plurality of heads; and a controller configured to control the heads and the irradiation sections, wherein the controller, when performing a printing, sequentially performs:

a first ejecting operation where one head of the plurality of heads ejects one electromagnetic wave hardened ink of the different electromagnetic wave hardened inks;

a first irradiation operation where an irradiation section, among the plurality of irradiation sections, corresponding to the one head irradiates the electromagnetic wave to the one electromagnetic wave hardened ink;

a second ejecting operation where another head different from the one head ejects another electromagnetic wave hardened ink different from the one electromagnetic wave hardened ink toward a pixel on the medium where the one electromagnetic wave hardened ink is ejected such that the another electromagnetic wave hardened ink overlaps the one electromagnetic wave hardened ink; and a second irradiation operation where an irradiation section corresponding to the another head irradiates the electromagnetic wave to the another electromagnetic wave hardened ink, and wherein the controller performs the operations such that a contact angle of the another electromagnetic wave hardened ink relative to the one electromagnetic wave hardened ink is greater than 90 degrees.

2. The printing device according to claim 1, wherein the plurality of irradiation sections are preliminary irradiation sections which temporarily harden the electromagnetic wave hardened inks by irradiating the electromagnetic waves to the electromagnetic wave hardened inks, wherein the printing device further includes a main irradiation section which really hardens the electromagnetic wave hardened inks by irradiating the electromagnetic wave to the electromagnetic wave hardened inks, independently from the plurality of irradiation sections, and wherein the controller, when performing a printing, performs the first ejecting operation, the first irradiation operation, the second ejecting operation, and the second irradiation operation, and thereafter controls the main irradiation section to perform a main hardening treatment where the electromagnetic wave hardened inks are really hardened.

3. The printing device according to claim 2, further comprising a movement instrument which moves the medium, wherein the controller, when performing a printing, performs the first ejecting operation, the first irradiation operation, the second ejecting operation, and the second irradiation operation, subsequently controls the movement instrument to perform a movement processing where the medium is moved, and thereafter performs the main hardening treatment.

4. The printing device according to claim 1, wherein the plurality of heads are colored ink heads which eject different electromagnetic wave hardened colored inks toward the medium, wherein the printing head further includes:

a clear ink head which ejects an electromagnetic wave hardened clear ink toward the medium, independently from the plurality of heads; and another irradiation section which irradiates the electromagnetic wave to the electromagnetic wave hardened clear ink, independently from the plurality of the irradiation sections, and wherein the controller, when performing a printing, sequentially performs:

a third ejecting operation where one head of the plurality of heads ejects one electromagnetic wave hardened ink of the different electromagnetic wave hardened inks;

a third irradiation operation where an irradiation section, among the plurality of irradiation sections, corresponding to the one head irradiates the electromagnetic wave to the one electromagnetic wave hardened ink;

a fourth ejecting operation where the clear ink head ejects the electromagnetic wave hardened clear ink toward a pixel on the medium where the one electromagnetic wave hardened ink is ejected such that the electromagnetic wave hardened clear ink overlaps the one electromagnetic wave hardened ink; and a fourth irradiation operation where the another irradiation section irradiates the electromagnetic wave to the electromagnetic wave hardened clear ink, and wherein the controller performs the operations such that a contact angle of the electromagnetic wave hardened clear ink relative to the one electromagnetic wave hardened ink is smaller than 90 degrees.

5. A printing method comprising:

preparing a printing device including a plurality of heads configured to eject different electromagnetic wave hardened inks toward a medium, a plurality of irradiation sections configured to respectively correspond to the plurality of heads and to respectively irradiate electromagnetic waves to the different electromagnetic wave hardened inks ejected from the plurality of heads, and a controller configured to control the heads and the irradiation sections;

performing a first ejecting operation where one head of the plurality of heads ejects one electromagnetic wave hardened ink of the different electromagnetic wave hardened inks;

performing a first irradiation operation where an irradiation section, among the plurality of irradiation sections, corresponding to the one head irradiates the electromagnetic wave to the one electromagnetic wave hardened ink;

performing a second ejecting operation where another head different from the one head ejects another electromagnetic wave hardened ink different from the one electromagnetic wave hardened ink toward a pixel on the medium where the one electromagnetic wave hardened ink is ejected such that the another electromagnetic wave hardened ink overlaps the one electromagnetic wave hardened ink; and performing a second irradiation operation where an irradiation section corresponding to the another head irradiates the electromagnetic wave to the another electromagnetic wave hardened ink, and wherein the operations are performed such that a contact angle of the another electromagnetic wave hardened ink relative to the one electromagnetic wave hardened ink is greater than 90 degrees.

* * * * *